US009052666B2

(12) United States Patent
Byun et al.

(10) Patent No.: US 9,052,666 B2
(45) Date of Patent: Jun. 9, 2015

(54) IMAGE FORMING APPARATUS AND METHOD FOR COLOR REGISTRATION CORRECTION

(75) Inventors: Ji-young Byun, Suwon-si (KR); Tae-young Kim, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 344 days.

(21) Appl. No.: 13/401,391

(22) Filed: Feb. 21, 2012

(65) Prior Publication Data

US 2012/0224891 A1 Sep. 6, 2012

(30) Foreign Application Priority Data

Mar. 3, 2011 (KR) ..... 2011-0019123

(51) Int. Cl.
*G03G 15/00* (2006.01)

(52) U.S. Cl.
CPC .... *G03G 15/5058* (2013.01); *G03G 2215/0125* (2013.01); *G03G 2215/0161* (2013.01)

(58) Field of Classification Search
CPC ..... G03G 15/5058; G03G 2215/0161; G03G 2215/0158; G03G 2215/00053; G03G 15/0189
USPC ..... 399/28–30, 48, 49, 297–302
See application file for complete search history.

(56) References Cited

U.S. PATENT DOCUMENTS

| | | | | |
|---|---|---|---|---|
| 2006/0188298 | A1* | 8/2006 | Aikawa | 399/301 |
| 2007/0165283 | A1* | 7/2007 | Matsuzaki et al. | 358/3.26 |
| 2009/0073469 | A1* | 3/2009 | Kita et al. | 358/1.9 |
| 2009/0297200 | A1* | 12/2009 | Takezawa et al. | 399/74 |
| 2010/0135702 | A1* | 6/2010 | Calamita et al. | 399/301 |
| 2011/0052228 | A1* | 3/2011 | Kozitsky et al. | 399/49 |

* cited by examiner

*Primary Examiner* — Walter L Lindsay, Jr.
*Assistant Examiner* — Jessica L Eley
(74) *Attorney, Agent, or Firm* — Staas & Halsey LLP

(57) ABSTRACT

A color registration method includes determining whether color registration is needed or not, if color registration is needed, setting an optimal amount of light of the registration sensor in a feedback manner, forming a predetermined mark for color registration correction on an image forming medium, and performing color registration correction with respect to the formed mark using the set optimal amount of light.

14 Claims, 13 Drawing Sheets

(a)

A boundary at which a total reflection value on a belt is saturated indicates an optimal amount of light.

(b)

An optimal amount of light of a sensor is calculated when a total reflection value on a whole section of one revolution of a belt is saturated.

(a)

(b)

(a)

(b)

| | Number of Fails | Number of Retries | ACR Job Fail(%) | ACR Job Retry(%) |
|---|---|---|---|---|
| Related-Art Algorithm | 5 | 38 | 4.27% | 32.48% |
| Algorithm of Present Invention | 0 | 27 | 0% | 8% |

| | Number of Retries | ACR Job Retry(%) |
|---|---|---|
| Related-Art Algorithm | 14 | 36.84% |
| Algorithm of Present Invention | 1 | 2.63% |

IMAGE FORMING APPARATUS AND METHOD FOR COLOR REGISTRATION CORRECTION

CROSS-REFERENCE TO RELATED APPLICATIONS

This application claims the benefit of Korean Patent Application No. 10-2011-0019123, filed on Mar. 3, 2011, in the Korean Intellectual Property Office, the disclosure of which is incorporated herein by reference.

BACKGROUND

1. Field

Aspects relate to an image forming apparatus and a method for color registration correction, and more particularly, to an image forming apparatus which can swiftly adjust an amount of light of a registration sensor, which examines an image alignment of the image forming apparatus, in a feedback manner, and a method for color registration correction.

2. Description of the Related Art

An electrophotographic printer such as a color laser printer includes four organic photo conductors Dy, Dc, Dm, and Dk prepared to respond to four colors, yellow, cyan, magenta, and black, a laser scanning unit to scan each of the organic photo conductors Dy, Dc, Dm, and Dk with a laser to form an electrostatic latent image of a desired image, a developing apparatus to develop the electrostatic latent image with color developers, and a transfer belt (or an intermediate transfer belt) to receive images developed on the organic photo conductors Dy, Dc, Dm, and Dk in sequence such that the images overlap with one another to form a complete color image, and transfer the color image to paper.

Accordingly, in order to print a desired single color image, the printer develops images for respective colors on the four organic photo conductors Dy, Dc, Dm, and Dk, moves the images to the same position of the transfer belt to make them overlap with one another to form a final color image, and transfer the final color image to paper.

However, in order to form the desired color image correctly by making the four colors overlap with one another at the same position on the transfer belt, transfer of the four color images from the organic photo conductors Dy, Dc, Dm, and Dk to the transfer belt should begin at the same position and ends at the same position on the transfer belt. Even if all images are clearly developed on the four organic photo conductors Dy, Dc, Dm, and Dk, a slight misalignment of the images on the transfer belt may cause a problem that a finally obtained color image does not correctly represent a color and an image.

Therefore, in order to represent a color image correctly, it is important to match a laser scanning time of the laser scanning unit for each organic photo conductor Dy, Dc, Dy, and Dk in consideration of a traveling speed of the transfer belt. A technique of matching the laser scanning time to make a plurality of colors overlap with one another to form a single image is referred to as 'color registration'.

The color registration is performed using a registration sensor provided in the image forming apparatus. The registration sensor projects light onto a registration pattern developed on an image forming medium and senses light reflected from the registration pattern, thereby measuring an error in alignment of images.

In order to measure the error in the alignment of the images accurately, the registration sensor should project light onto the image forming medium based on a correct amount of light.

More specifically, if an amount of light of the registration sensor is greater than a predetermined value, some of the registration patterns developed on the transfer belt may not be recognized. If the amount of light of the registration sensor is less than the predetermined value, contamination on the transfer belt may be recognized as a pattern.

In a related-art method for detecting an amount of light of the registration sensor, a PWM duty is input to the registration sensor in a stepwise manner, and, when the amount of light reaches a target amount of light according to a change in the PWM duty, the amount of light by the corresponding PWM duty is used for color registration.

However, the related-art method requires long time to detect the amount of light of the registration sensor because a series of operations of changing the PWM duty in sequence should be performed.

Also, the amount of light of the registration sensor may not be detected since the target amount of light falls between the PWM duty steps in the case of an image forming apparatus of high reflectivity.

SUMMARY

Accordingly, it is an aspect to provide an image forming apparatus which can swiftly adjust an amount of light a registration sensor, which examines an alignment of an image of the image forming apparatus, in a feedback manner, and a method for color registration correction.

Additional aspects and/or advantages will be set forth in part in the description which follows and, in part, will be apparent from the description, or may be learned by practice of the invention.

The foregoing and/or other aspects are achieved by providing a color registration method of an image forming apparatus which includes a registration sensor, the color registration method including determining whether color registration is needed or not, if color registration is needed, setting an optimal amount of light of the registration sensor in a feedback manner, forming a predetermined mark for color registration correction on an image forming medium, and performing color registration correction with respect to the formed mark using the set optimal amount of light.

The setting the optimal amount of light may include providing a predetermined initial control signal to the registration sensor, sensing an amount of light reflected from the image forming medium, calculating a control signal according to a difference between the sensed amount of light and a predetermined target amount of light, determining whether an amount of light of the registration sensor has a stable value or not, by comparing the sensed amount of light and the target amount of light, if the amount of light of the registration sensor has the stable value, selecting an amount of light of the registration sensor corresponding to the sensed amount of light as the optimal amount of light, and providing the calculated control signal to the registration sensor and repeating the sensing, the calculating, and the determining.

The target amount of light may be an amount of light at a time when the amount of light reflected from the image forming medium is saturated.

The calculating the control signal may include calculating the control signal according to the sensed amount of light and the target amount of light using at least one of a PI control and a PID control.

The setting the optimal amount of light may be performed while rotating the image forming medium.

The repeating may include repeating the sensing, the calculating, and the determining from when the amount of light of the registration sensor has the stable value to when the image forming apparatus is rotated one revolution.

The setting the optimal amount of light may further include storing the calculated control signal and an amount of light sensed in response to the calculated control signal.

The setting the optimal amount of light may further include calculating an average value of the sensed amount of light and a maximum value of the sensed amount of light using the stored amount of light, and comparing the calculated average value and the calculated maximum value, and the selecting the amount of light may include, if a difference between the calculated maximum value and the calculated average value is less than a predetermined value, selecting an amount of light of the registration sensor corresponding to the calculated maximum value as the optimal amount of light, and, if the difference between the calculated maximum value and the calculated average value is greater than the predetermined value, selecting an amount of light obtained by adding a predetermined offset value to an amount of light of the registration sensor corresponding to the calculated average value, as the optimal amount of light.

The selecting the amount of light may include, if the difference between the calculated maximum value and the calculated average value is less than the predetermined value, selecting an amount of light of the registration sensor corresponding to the calculated average value as the optimal amount of light.

The image forming medium may be at least one of an organic photo conductor, an intermediate transfer belt, and a paper conveyance belt.

The foregoing and/or other aspects may also be achieved by providing an image forming apparatus including a controller which determines whether color registration is needed or not, a color registration unit which, if color registration is needed, setting an optimal amount of light of a registration sensor in a feedback manner, and an image forming unit which forms a predetermined mark for color registration correction on an image forming medium, wherein the color registration unit performs color registration correction with respect to the formed mark using the set optimal amount of light.

The color registration unit may include a registration sensor unit which emits light toward the image forming medium according to an input control signal and senses an amount of light reflected from the image forming medium, and a feedback controller which provides a control signal to the registration sensor unit, performs a feedback control with respect to the control signal input to the registration sensor unit according to a difference between an amount of light sensed according to the control signal and a predetermined target amount of light, and selects an amount of light of the registration sensor unit corresponding to the sensed amount of light, if an amount of light of the registration sensor unit has a stable value The target amount of light may be an amount of light at a time when the amount of light reflected from the image forming medium is saturated.

The feedback control may be at least one of a PI control and a PID control.

The image forming apparatus may further include a medium driving unit which rotates the image forming medium, and the color registration unit may control the medium driving unit such that the image forming medium is rotated when the optimal amount of light of the registration sensor is set.

The color registration unit may control the medium driving unit such that the image forming medium is rotated one more revolution when the amount of light of the registration sensor unit has the stable value.

The image forming apparatus may further include a storage unit which stores the calculated control signal and an amount of light sensed in response to the calculated control signal.

The color registration unit may calculate an average value of the sensed amount of light and a maximum value of the sensed amount of light using the stored amount of light, select an amount of light of the registrations sensor unit corresponding to the calculated maximum value as the optimal amount of light, if a difference between the calculated maximum value and the calculated average value is less than a predetermined value, and select an amount of light of the registration sensor unit obtained by adding a predetermined offset value to an amount of light of the registration sensor corresponding to the calculated average value as the optimal amount of light, if the difference between the calculated maximum value and the calculated average value is greater than the predetermined value.

If the difference between the calculated maximum value and the calculated average value is less than the predetermined value, the color registration sensor unit may select an amount of light of the registration sensor unit corresponding to the calculated average value as the optimal amount of light.

The image forming medium may be at least one of an organic photo conductor, an intermediate transfer belt, and a paper conveyance belt.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
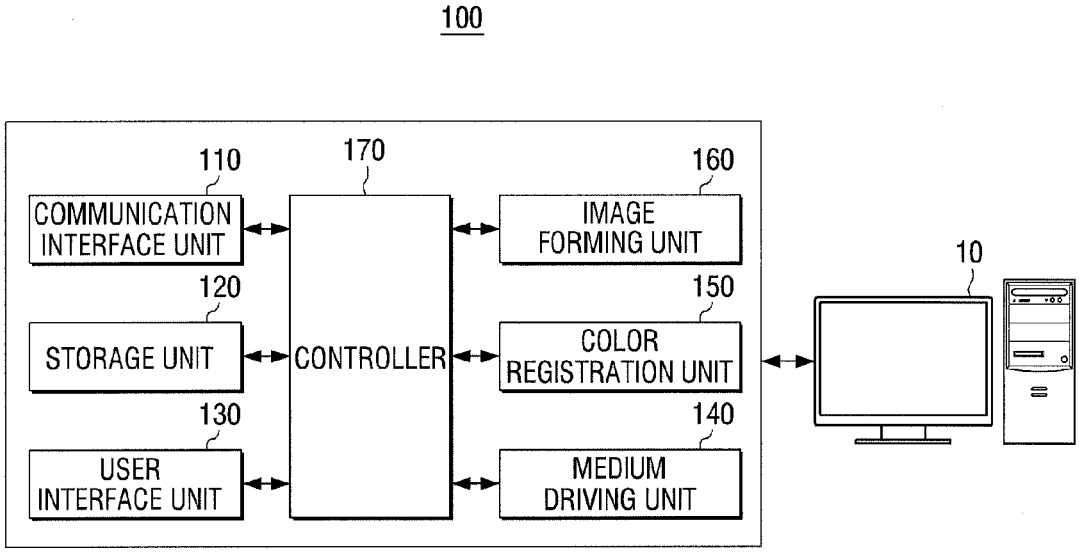
FIG. 1 is a block diagram illustrating an image forming apparatus according to an exemplary embodiment.

Reference will now be made in detail to the present embodiments, examples of which are illustrated in the accompanying drawings, wherein like reference numerals refer to the like elements throughout. The embodiments are described below in order to explain the embodiments by referring to the figures. It should be understood that various features are not drawn to scale and the dimensions of the various features may be arbitrarily increased or reduced for clarity of discussion.

FIG. 1 is a block diagram illustrating an image forming apparatus according to an exemplary embodiment.

Referring to FIG. 1, an image forming apparatus 100 according to an exemplary embodiment comprises a communication interface unit 110, a storage unit 120, a user interface unit 130, a medium driving unit 140, a color registration unit 150, an image forming unit 160, and a controller 170.

The communication interface unit 110 is connected to a printing control terminal apparatus 10 such as a personal computer, a laptop computer, a personal digital assistant (PDA), or a digital camera. More specifically, the communication interface unit 110 is adapted to connect the image forming apparatus 100 to an external apparatus and may access the external apparatus through a local area network (LAN) or internet or through a universal serial bus (USB) port. Also, the communication interface unit 110 may access the printing control terminal apparatus 10 in a wireless manner as well as a wired manner.

Also, the communication interface unit 110 receives printing data from the printing control terminal apparatus 10. The communication interface unit 110 may receive a command to perform color registration from the printing control terminal apparatus 10.

The storage unit 120 stores the printing data. More specifically, the storage unit 130 stores the printing data received through the communication interface unit 110. Also, the storage unit 130 stores history information on a printing job performed in the image forming apparatus 100. Also, the storage unit 120 may store a control signal which is calculated by the color registration unit 150 and an amount of light which is sensed in response to the calculated control signal.

The storage unit 120 may be realized by an internal or external storage medium of the image forming apparatus 100, for example, by a removable disk including an USB memory or a web server connected through a network. In this embodiment, the storage unit 120 is disposed outside the color registration unit 150. However, the storage unit 120 may be disposed inside the color registration unit 150.

The user interface unit 130 is provided with a plurality of function keys through which a user sets or selects various functions supported by the image forming apparatus 100, and displays diverse information provided by the image forming apparatus 100. The user interface unit 130 may be realized by a device implementing input and output simultaneously such as a touch pad or by a device combining functions of a mouse and a monitor. The user may input the command to perform the color registration for the image forming apparatus 100 using a user interface window provided through the user interface unit 130.

The medium driving unit 140 rotates an image forming medium. More specifically, the medium driving unit 140 may drive the image forming medium such as an organic photo conductor (OPC) on which an image is formed, an intermediate transfer belt (ITB), and a paper conveyance belt.

If color registration is needed, the color registration unit 150 sets an optimal amount of light of a registration sensor in a feedback manner. Also, the color registration unit 150 may perform color registration correction using the set optimal amount of light. A configuration and an operation of the color registration unit 150 will be explained below in detail with reference to FIG. 2.

The image forming unit 160 forms an image. More specifically, the image forming unit 160 may form the image on the image forming medium such as the OPC, the ITB, and the paper conveyance belt.

The image forming unit 160 forms a predetermined mark for color registration correction on the image forming medium. The predetermined mark may use a total reflection pattern or a diffuse reflection pattern and may use a variety of patterns according to control methods.

The controller 170 controls the elements of the image forming apparatus 100. More specifically, if the controller 170 receives printing data from the printing control terminal apparatus 10, the controller 170 controls the image forming unit 160 to print the printing data.

Also, the controller 170 determines whether color registration is needed or not. More specifically, if printing is performed as much as a predetermined number of copies based on the history information stored in the storage unit 120 or if the command to perform the color registration is input from the printing control terminal apparatus 10 or the user interface unit 130, the controller 170 determines that the color registration is needed.

Also, if it is determined that the color registration is needed, the controller 170 may control the color registration unit 150 to perform the color registration.

Figure 2:
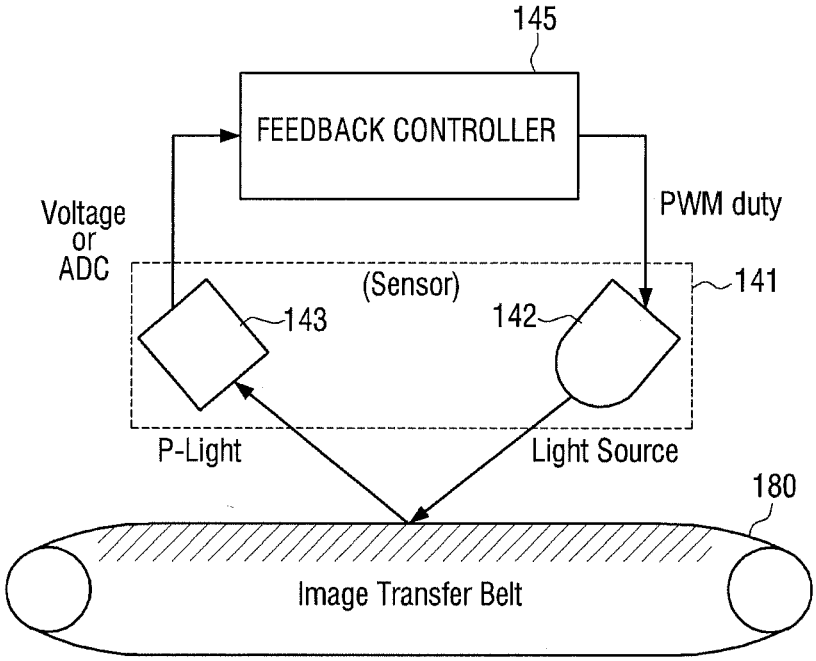
FIG. 2 is a view illustrating a color registration unit of FIG. 1 in detail.

FIG. 2 is a view illustrating the color registration unit 150 of FIG. 1 in detail.

Referring to FIG. 2, the color registration unit 150 comprises a registration sensor unit 141 and a feedback controller 145.

The registration sensor unit 141 includes a light emitting unit 142 and a light receiving unit 143. The light emitting unit 142 emits light toward the image forming medium 180 at a constant level according to a control signal provided by the feedback controller 145, and the light receiving unit 143 senses light reflected from the image forming medium 180 out of the light emitted from the light emitting unit 142. The light emitting unit 142 may be realized by an light emitting diode (LED). The control signal input to the light emitting unit 142 may be a pulse width modulation (PWM) signal having a constant duty to control an amount of light of the LED.

The feedback controller 145 adjusts an amount of light of a registration sensor in a feedback manner. Specifically, the feedback controller 145 provides the registration sensor 141 with a predetermined initial control signal and performs a feedback control with respect to the control signal input to the registration sensor unit 141 according to a difference between an amount of light sensed by the registration sensor unit 141 and a predetermined target amount of light. If the amount of light sensed by the registration sensor unit 141 has a stable value, the amount of light is selected as an optimal amount of light. Such a feedback control may be performed in a proportional-integral (PI) control method or a proportional-integral derivative (PID) control method. A detailed operation of the feedback controller 141 in the PI control method will be explained below with reference to FIG. 3. The target amount of light recited herein refers to an amount of light at a time when the amount of light reflected from the image forming medium is saturated.

The feedback controller 145 may control the medium driving unit 140 such that the image forming medium is rotated when the optimal amount of light of the registration sensor is set.

More specifically, the feedback controller 145 may control the medium driving unit 140 such that the image forming medium is rotated at a time when a reference amount of light is adjusted, and may control the medium driving unit 140 such that the image forming medium is rotated one more revolution when the amount of light of the registration sensor has a stable value.

Figure 9:
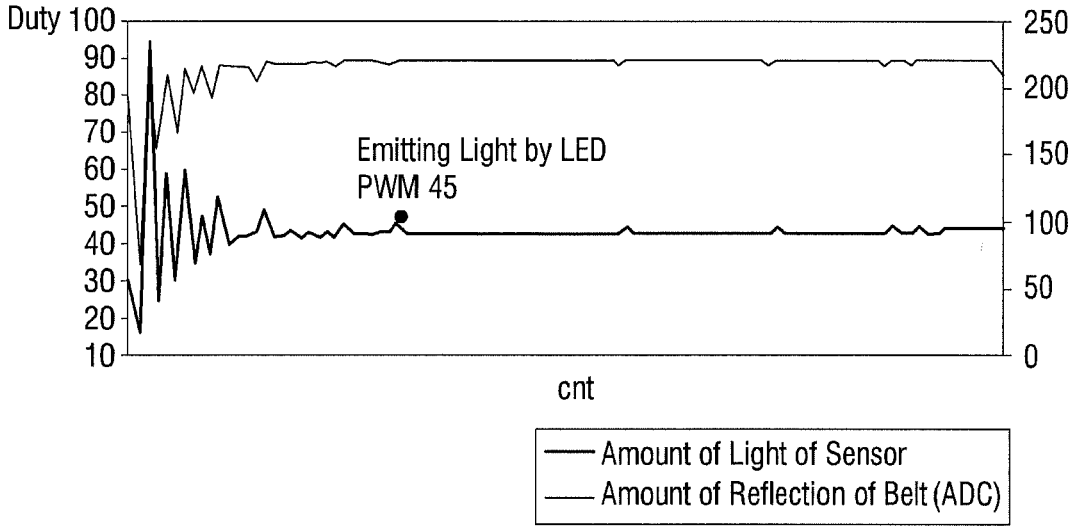
FIGS. 9 and 10 are views to explain an optimal amount of light of a registration sensor, which is determined according to whether a noise exists or not.

The feedback controller 145 may control the storage unit 120 to store a control signal which is calculated while the image forming medium is being rotated one more revolution and an amount of light sensed in response to the calculated control signal. Also, if the image forming medium has no noise component or has a very small noise component, if any, as shown in FIG. 9, the feedback controller 145 may select an amount of light of the registration sensor corresponding to the sensed amount of light as the optimal amount of light.

Figure 10:
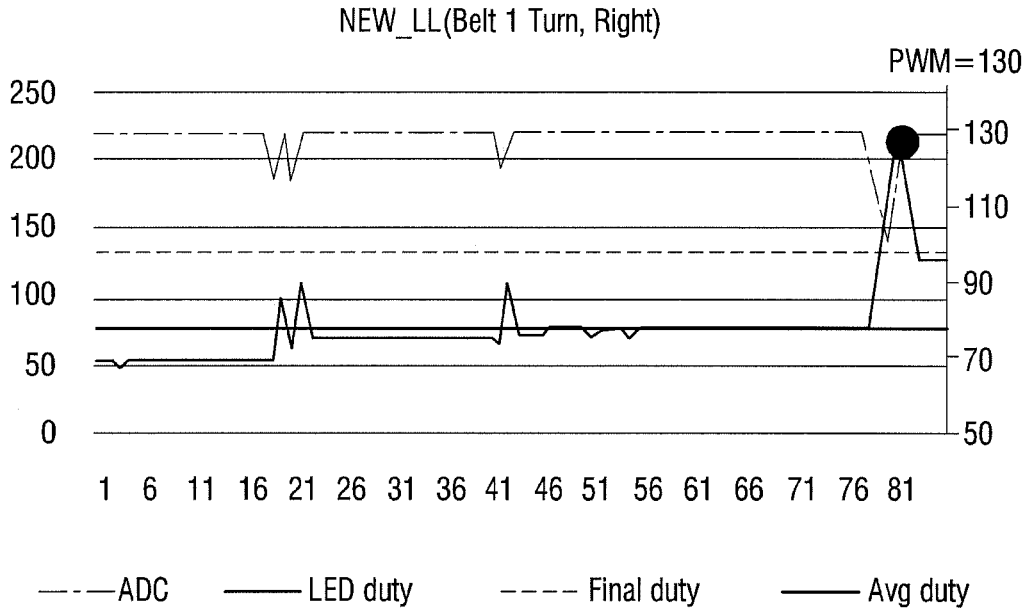

On the other hand, if the image forming medium has a noise component as shown in FIG. 10, the feedback controller 145 calculates an average value of the amount of light sensed while the image forming medium is being rotated one more revolution and calculates a maximum value of the stored amount of light. If a difference between the maximum value and the average value is less than a predetermined value, the amount of light of the registration sensor corresponding to the maximum value is selected as the optimal amount of light. If the difference between the maximum value and the average value is greater than the predetermined value, the feedback controller 145 selects an amount of light obtained by adding a predetermined offset to the amount of light of the registration sensor corresponding to the average value, as the optimal amount of light. In practice, if the difference between the maximum value and the average value is less than the predetermined value, the feedback controller 145 may select the amount of light of the registration sensor corresponding to the average value as the optimal amount of light.

By performing the above-described operation, the optimal amount of light is set, reflecting the noise component existing in the image forming medium as a part on which reflectivity of the image forming medium is reduced.

In FIG. 2, the color registration unit 150 comprises one registration sensor unit and one feedback controller. However, as the color registration may be performed in two areas of the image forming medium, the color registration unit 150 may include two registration sensor units 141-1 and 141-2 (See FIG. 4, part (a)) and two feedback controllers. Also, the two registration sensor units and a single feedback controller for performing a feedback control with respect to the two registration sensor units simultaneously may be used.

Figure 3:
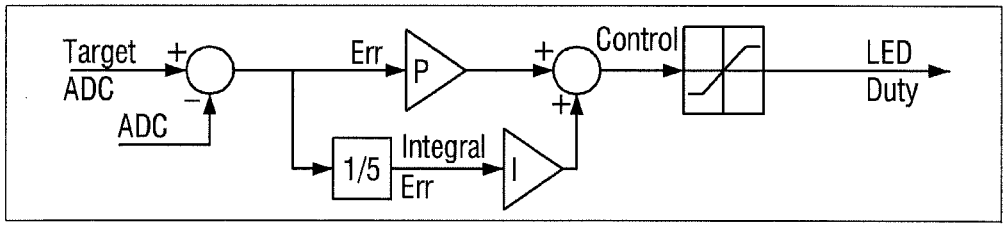
FIG. 3 is a view to explain an operation of a feedback controller of FIG. 2 in detail.

FIG. 3 is a view to explain a detailed operation of the feedback controller 145 of FIG. 2.

Referring to FIG. 3, the feedback controller 145 receives a target amount of light and an amount of light sensed by the light receiving unit 143.

The feedback controller 145 calculates an error by comparing the target amount of light and the amount of light sensed by the light receiving unit 143.

The feedback controller 145 multiplies the error by a proportional gain as well as by an integral gain, and adds the error multiplied by the proportional gain and the error multiplied by the integral gain to generate a control signal with respect to the registrations sensor. The control signal may be a PWM signal having a constant duty ratio for controlling the amount of light of the light emitting unit 142.

The control signal is input to the registration sensor unit 141 and the registration sensor unit 141 projects light according to the control signal. Light reflected from the image forming medium out of the projected light is sensed by the registration sensor unit 141 and an amount of the sensed light is input to the feedback controller 145. Through the above-described process, the feedback controller 145 performs a PI control with respect to the amount of light emitted from the registration sensor unit 141.

In FIG. 3, the feedback controller 145 adjusts the amount of light emitted from the registration sensor unit 141 in a PI control method. However, the amount of light emitted from the registration sensor unit 141 may be adjusted using a PID control method.

Figure 4:
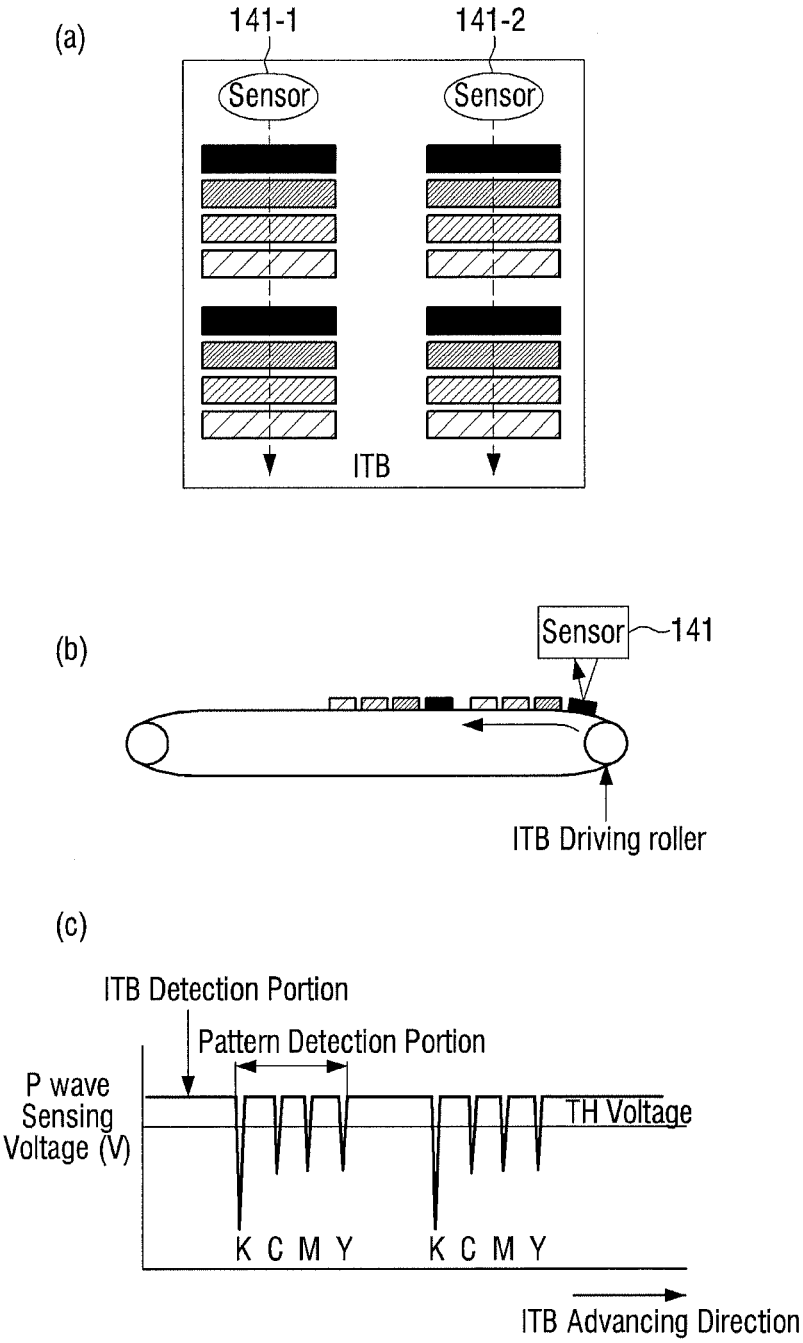
FIG. 4, parts (a)-(c), is a view to explain a color registration operation according to an exemplary embodiment.

FIG. 4, parts (a)-(c), is a view to explain a color registration operation according to an exemplary embodiment.

First, the image forming unit 160 forms a predetermined mark necessary for color registration correction on the image forming medium as shown in parts (a) and (b) of FIG. 4.

A light emitting unit 142 of a registration sensor unit 141 projects light onto the image forming medium and consequently a light receiving unit 143 of the registration sensor unit 141 detects a reflection pattern. In other words, the reflection pattern is measured as a voltage level by the light receiving unit 143. The reflection pattern detected by the light receiving unit 143 is shown in part (c) of FIG. 4.

A color registration unit 150 may detect a position of the pattern by comparing a voltage level measured by the light receiving unit 143 and a predetermined voltage level. The color registration unit 140 may perform color registration correction according to the position of the pattern.

Figure 5:
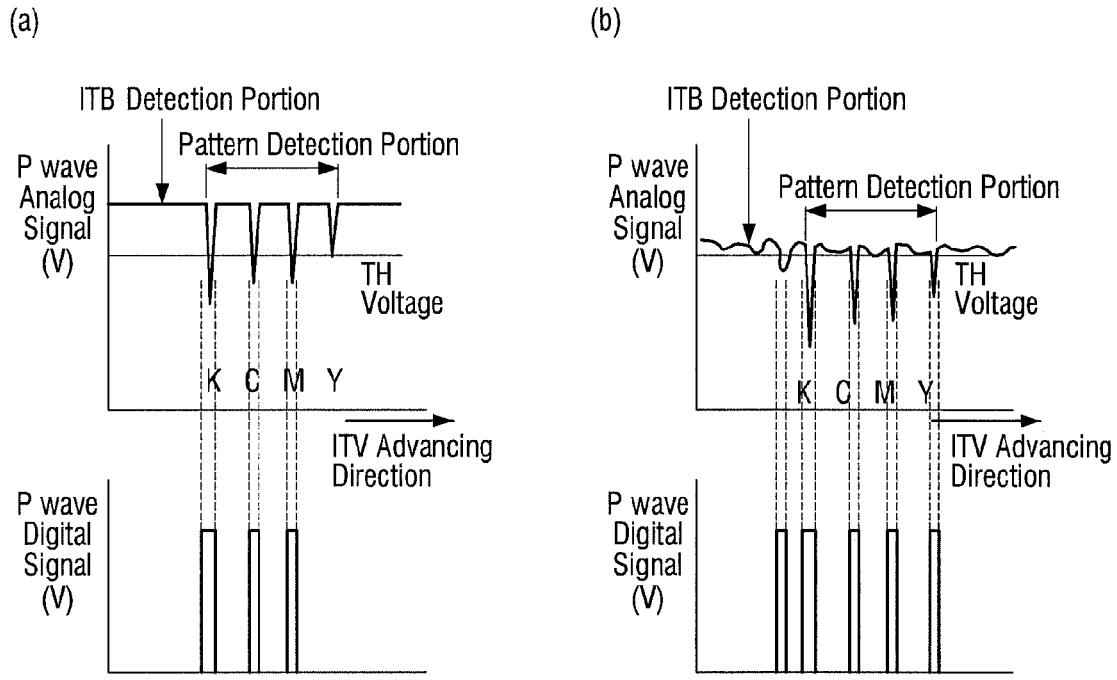
FIG. 5, parts (a) and (b), is a view to explain an effect of color registration caused by a change in an amount of light of a registration sensor.

If an amount of light emitted from the light emitting unit 142 is set to be high while the color registration correction is performed, an amount of reflection of each color formed on the image forming medium increases. In particular, an amount of reflection of a yellow pattern, which is bright color, noticeably increases and thus the yellow pattern may not be recognized as shown in part (a) of FIG. 5.

On the other hand, if the amount of light emitted from the light emitting unit 142 is set to be low while the color registration correction is performed, an amount of reflection of a surface of the image forming medium is not sufficiently saturated and thus an amount of surface reflection of the image forming medium is not uniform. Also, a noise component value, which is small and unnecessary, is recognized as having a voltage level and thus a unnecessary pattern may be recognized as shown in part (b) of FIG. 5.

Accordingly, in order to perform the color registration correction exactly, the light emitting unit 142 may be set to project an appropriate amount of light. Hereinafter, a method for detecting an optimal amount of light of the light emitting unit 142 will be explained.

Figure 6:
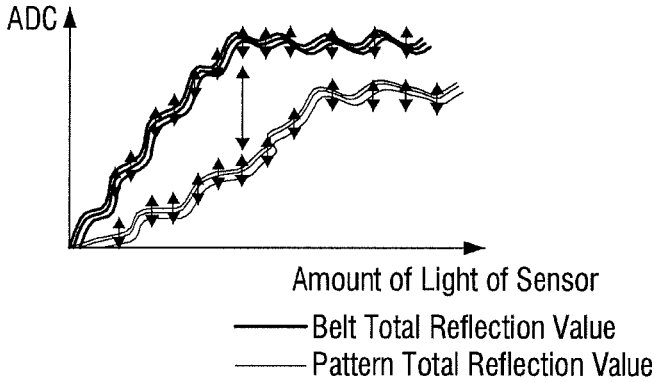
FIGS. 6, parts (a) and (b), 7, parts (a) and (b), and 8, parts (a) and (b), are views to explain an optimal amount of light used in a registration sensor according to an exemplary embodiment.
Figure 6:
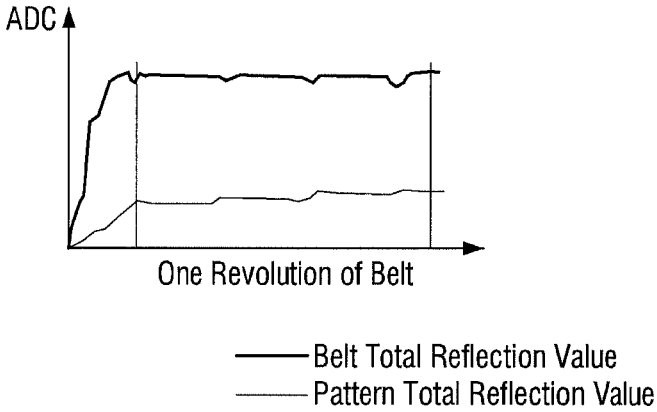

FIG. 6, parts (a) and (b), is a view to explain an optimal amount of light used by a registration sensor according to an exemplary embodiment.

As described above, if a signal level sensed from a surface of the image forming medium is not sufficiently saturated, an unnecessary noise component may be detected from the surface of the image forming medium. However, if the signal level is excessively saturated, a pattern may not be recognized when registration correction is performed.

Therefore, since a difference between a total reflection value on the image forming medium and a total reflection value on the pattern is the largest before the amount of light reflected from the image forming medium is saturated, as shown in part (a) of FIG. 6, an amount of light at a time when the amount of light reflected from the image forming medium is saturated may be used for the color registration correction.

In case that a noise component exists in the image forming medium, an amount of light at a time when an amount of light reflected from a rotation section of the image forming medium is saturated may be calculated as shown in part (b) of FIG. 6.

Figure 7:
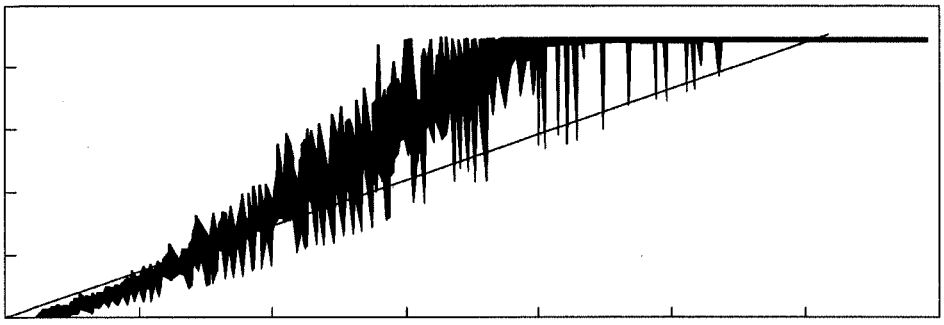
Figure 7:
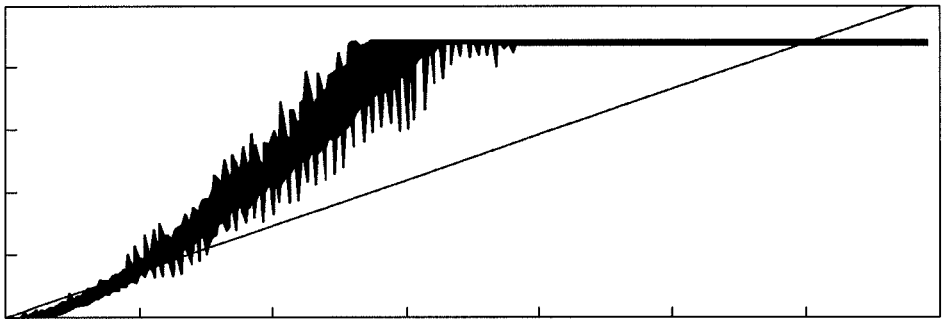
Figure 8:
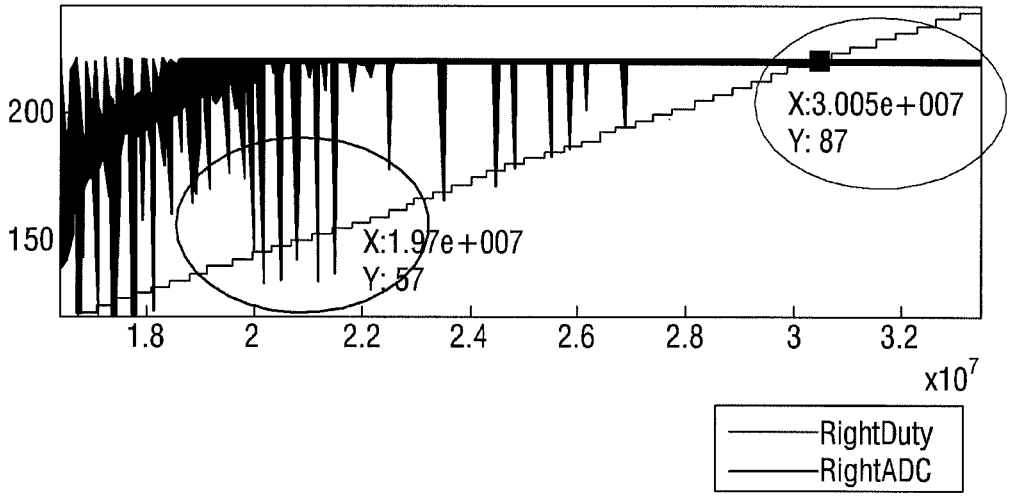
Figure 8:
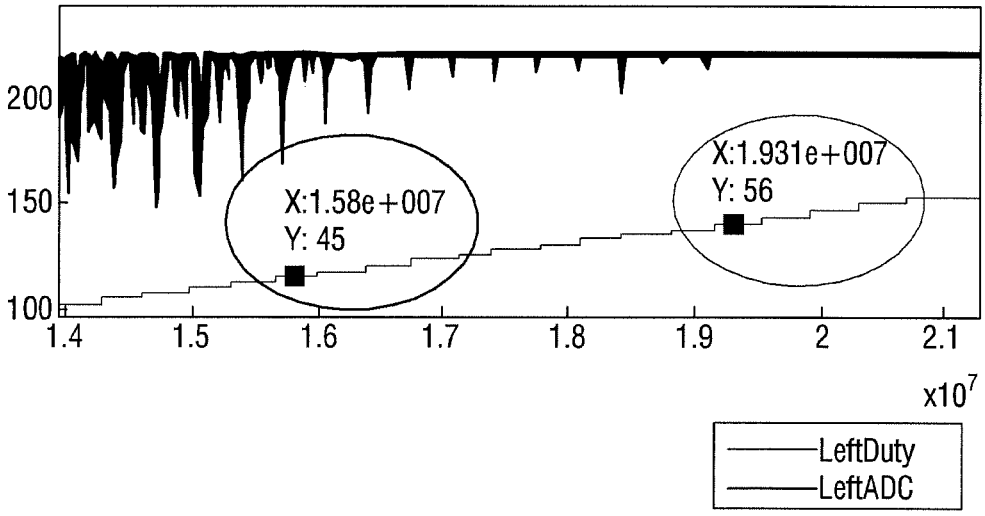

Specifically, an optimal amount of light may be calculated based on feedback on a state of one revolution of the image forming medium so that a portion in which an amount of reflection is reduced (a noise component: scratch on a belt and attachment of a toner) out of the whole area of the image forming medium does not affect the color registration correction. FIG. 7, parts (a) and (b), shows an amount of reflection per one revolution of the intermediate transfer belt to which toner is not attached, if an amount of light of the registration sensor increases, and FIG. 8, parts (a) and (b), is an enlarged view of a portion of FIG. 7, parts (a) and (b).

Referring to FIGS. 7, parts (a) and (b), and 8, parts (a) and (b), it can be seen that the amount of reflection is reduced at some portion due to an unknown defect of the intermediate transfer belt when the intermediate transfer belt is rotated. Accordingly, the amount of light in the right circle of FIG. 8, parts (a) and (b), is selected as the amount of light of the registration sensor.

FIGS. 11 to 15 are views illustrating results of experiments to test performance of a method for detecting an optimal amount of light according to an exemplary embodiment.

Figures 11, 12:
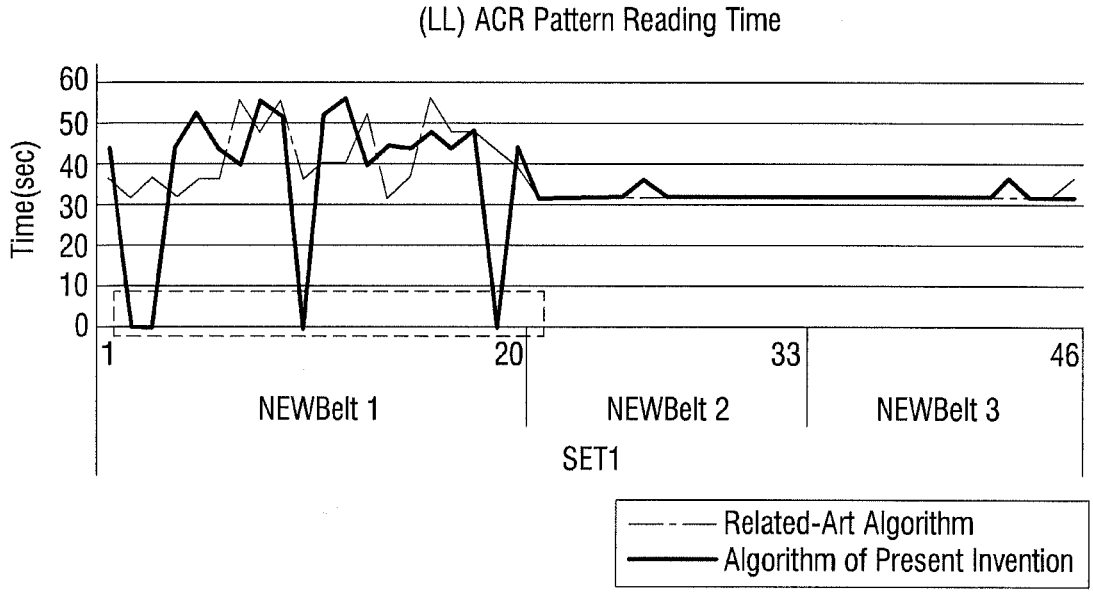
FIGS. 11 to 15 are views illustrating results of experiments to test performance of a method for detecting an optimal amount of light according to an exemplary embodiment.
Figures 13, 14:
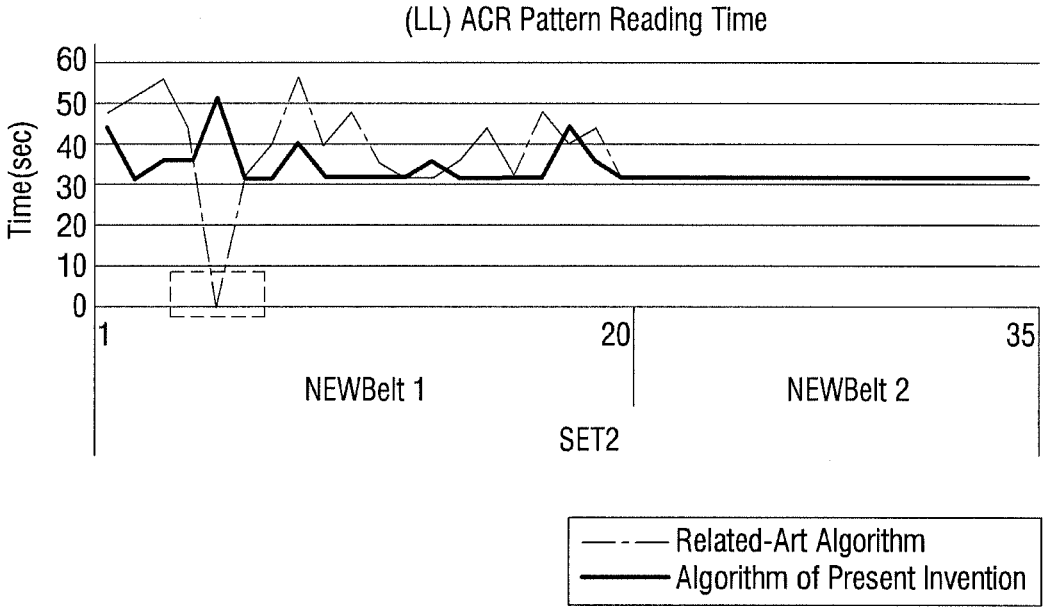
Figure 15:
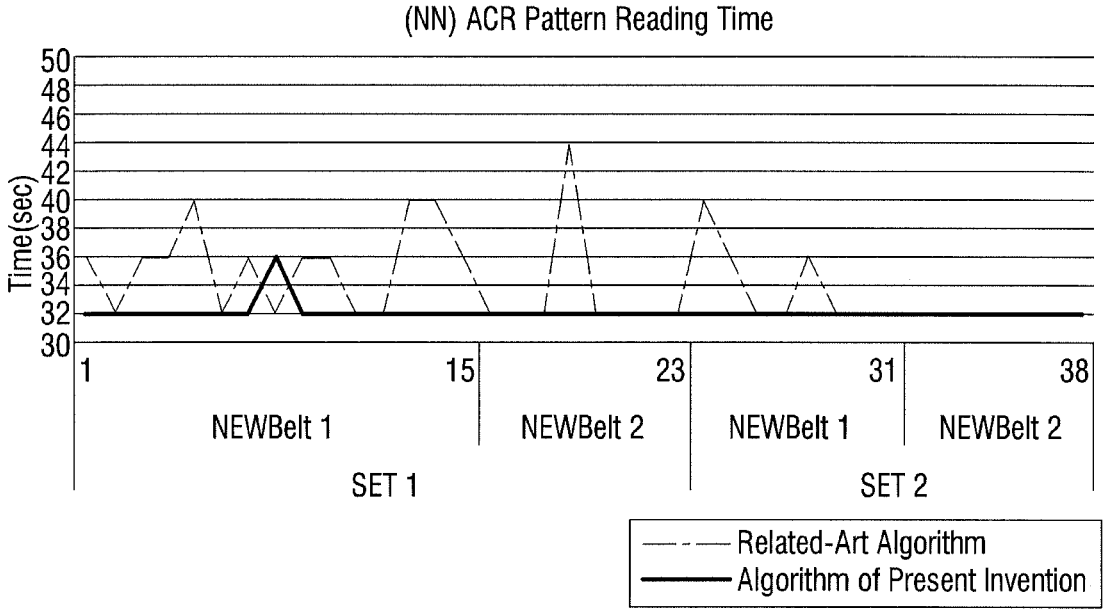

Specifically, FIGS. 11 to 13 illustrate a result of an experiment conducted using a color registration operation according to the present embodiment and a related-art color registration operation at a low temperature and a low humidity level. FIGS. 14 and 15 illustrate a result of an experiment conducted using the color registration operation according to the present embodiment and the related-art color registration operation at a high temperature and a high humidity level.

Referring to FIG. 11, if an optimal amount of light is set using a feedback control method according to the present embodiment, a failure rate of the color registration operation and a retry rate of the color registration operation are noticeably reduced in comparison with the related-art method. In particular, referring to box areas of FIGS. 12 and 13, if a condition of the intermediate transfer belt is not good, color registration may not be performed in the related-art method. However, even if the condition of the intermediate transfer belt is not good, the feedback control method according to the present embodiment can achieve color registration.

Referring to FIG. 14, if a reference amount of light of the registrations sensor is detected using the feedback control method of the present embodiment, a retry rate of the color registration operation is noticeably reduced in comparison with the related-art.

Figure 16:
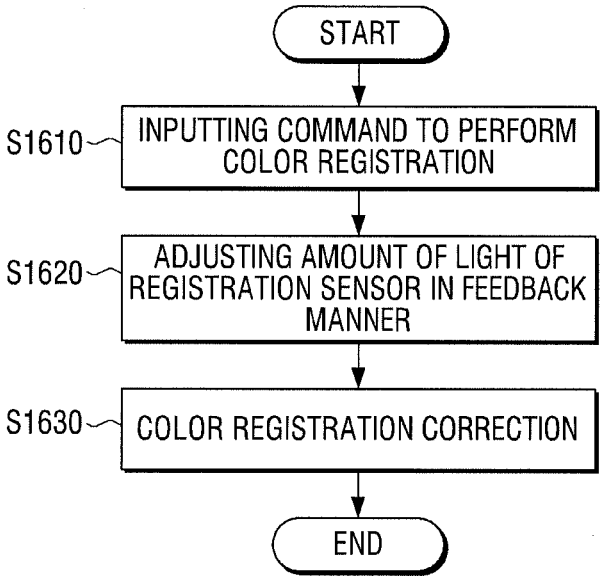
FIG. 16 is a view illustrating a method for color registration according to an exemplary embodiment.

FIG. 16 is a flowchart illustrating a method for color registration according to an exemplary embodiment.

Referring to FIG. 16, it is determined whether color registration is needed or not (S1610). More specifically, if a printing operation is performed in the image forming apparatus as much as a predetermined number of copies or if a command to perform color registration is input by a user, it is determined that color registration is needed.

If it is determined that color registration is needed, an optimal amount of light of the color registration sensor is set in a feedback manner (S1620). A detailed operation of setting the optimal amount of light will be explained below with reference to FIG. 17.

If the optimal amount of light is set, color registration correction is performed (S1630). More specifically, a predetermined mark for the color registration correction is formed and the color registration correction is performed with respect the mark using the optimal amount of light.

Figure 17:
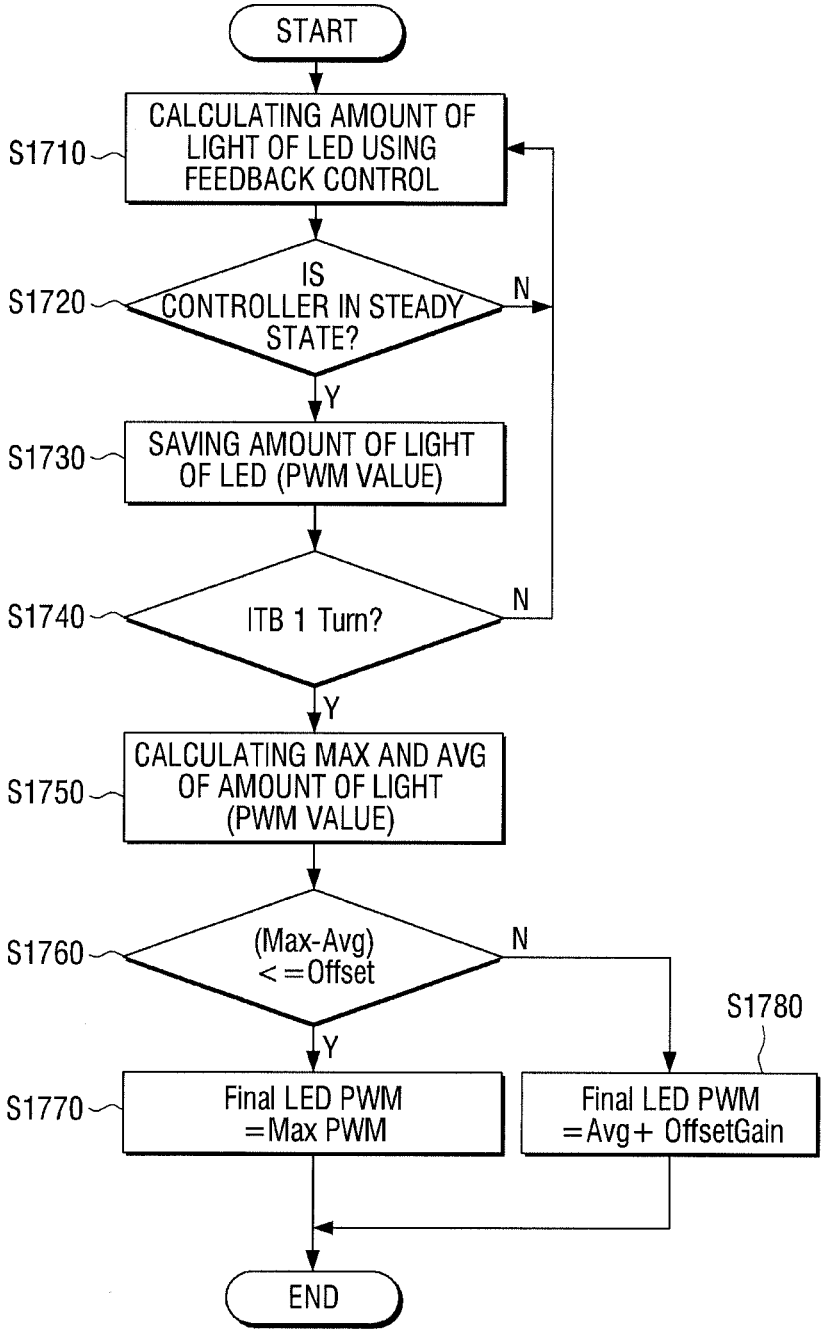
FIG. 17 is a view to explain a method for setting an optimal amount of light of FIG. 16.

FIG. 17 is a flowchart illustrating the method for setting the optimal amount of light of FIG. 16 in detail.

Referring to FIG. 17, an image forming medium is rotated. A predetermined initial control signal is provided to a registration sensor and the registration sensor senses an amount of light reflected from the image forming medium out of the light emitted in response to the initial control signal. A control signal to be input to the registration sensor is calculated according to a difference between the sensed amount of light and a predetermined target amount of light (S1710). The target amount of light refers to an amount of light at a time when the amount of light reflected from the image forming medium is saturated.

Also, it is determined whether the amount of light of the registration sensor has a stable value or not by comparing the sensed amount of light and the target amount of light (S1720).

If the amount of light of the registration sensor does not have a stable value (S1720-N), the calculated control signal is provided to the registration sensor and the above-described operations are repeated (S1730). In other words, a feedback control is performed as shown in FIG. 3.

On the other hand, if the amount of light of the registration sensor has a stable value (S1720-Y), the calculated control signal and an amount of light sensed in response to the calculated control signal are stored (S1730).

It is determined whether the image forming medium is rotated one more revolution after the amount of light of the registration sensor has been stabilized (S1740). If the image forming medium is not rotated one more revolution (S1740-N), the above-described operations are repeated until the image forming medium is rotated one more revolution.

If the image forming medium is rotated one more revolution after the amount of light of the registration sensor has been stabilized (S1740-Y), an average value of the stored amount of light and a maximum value of the stored amount of light are calculated (S1750).

The calculated maximum value and the calculated average value are compared (S1760).

If a difference between the calculated maximum value and the calculated average value is less than a predetermined value, an amount of light of the registration sensor corresponding to the calculated maximum value is set as a reference amount of light (S1770). In practice, an amount of light of the registration sensor corresponding to the calculated average value may be set as a reference amount of light.

On the other hand, if the difference between the calculated maximum value and the calculated average value is greater than the predetermined value, an amount of light obtained by adding a predetermined offset value to an amount of light of the registration sensor corresponding to the calculated average value is set as a reference amount of light (S1780).

Accordingly, in the color registration method according to the present exemplary embodiment; an optimal amount of light of the registration sensor can be set swiftly. Also, since the condition of the image forming medium is considered in adjusting the reference amount of light, the color registration correction can be performed using the more robust optimal amount of light. The color registration method of FIGS. 16 and 17 may be performed in the image forming apparatus 100 shown in FIG. 1 and also may be performed any other image forming apparatus.

Although a few embodiments have been shown and described, it would be appreciated by those skilled in the art that changes may be made in this embodiment without departing from the principles and spirit of the invention, the scope of which is defined in the claims and their equivalents.

What is claimed is:

1. A color registration method of an image forming apparatus which comprises a registration sensor, the color registration method comprising:

determining whether color registration is needed or not;

if color registration is needed, setting an optimal amount of light of the registration sensor in a feedback manner;

forming a predetermined mark for color registration correction on an image forming medium; and performing color registration correction with respect to the formed mark using the set optimal amount of light;

wherein the feedback manner adjusts an amount of light of the registration sensor such that a sensed amount of light is adjusted to a predetermined target amount of light, wherein the setting the optimal amount of light is performed while rotating the image forming medium and comprises:

providing a predetermined initial control signal to the registration sensor;

sensing an amount of light reflected from the image forming medium;

calculating a control signal according to a difference between the sensed amount of light and a predetermined target amount of light;

determining whether an amount of light of the registration sensor has a stable value or not, by comparing the sensed amount of light and the target amount of light;

if the amount of light of the registration sensor has the stable value, selecting an amount of light of the registration sensor corresponding to the sensed amount of light as the optimal amount of light; and providing the calculated control signal to the registration sensor and repeating the sensing, the calculating, and the determining from when the amount of light of the registration sensor has the stable value to when the image forming apparatus is rotated one additional revolution.

2. The method as claimed in claim 1, wherein the target amount of light is an amount of light at a time when the amount of light reflected from the image forming medium is saturated.

3. The method as claimed in claim 1, wherein the calculating the control signal comprises calculating the control signal according to the sensed amount of light and the target amount of light using at least one of a proportional-integral (PI) control and a proportional-integral derivative (PID) control.

4. The method as claimed in claim 1, wherein the setting the optimal amount of light further comprises storing the calculated control signal and an amount of light sensed in response to the calculated control signal.

5. The method as claimed in claim 4, wherein the setting the optimal amount of light further comprises:

calculating an average value of the sensed amount of light and a maximum value of the sensed amount of light using the stored amount of light; and comparing the calculated average value and the calculated maximum value, wherein the selecting the amount of light comprises, if a difference between the calculated maximum value and the calculated average value is less than a predetermined value, selecting an amount of light of the registration sensor corresponding to the calculated maximum value as the optimal amount of light, and, if the difference between the calculated maximum value and the calculated average value is greater than the predetermined value, selecting an amount of light obtained by adding a predetermined offset value to an amount of light of the registration sensor corresponding to the calculated average value, as the optimal amount of light.

6. The method as claimed in claim 5, wherein the selecting the amount of light comprises, if the difference between the calculated maximum value and the calculated average value is less than the predetermined value, selecting an amount of light of the registration sensor corresponding to the calculated average value as the optimal amount of light.

7. The method as claimed in claim 1, wherein the image forming medium is at least one of an organic photo conductor, an intermediate transfer belt, and a paper conveyance belt.

8. An image forming apparatus comprising:

a controller which determines whether color registration is needed or not;

a color registration unit which, if color registration is needed, sets an optimal amount of light of a registration sensor in a feedback control; and an image forming unit which forms a predetermined mark for color registration correction on an image forming medium, wherein the color registration unit performs color registration correction with respect to the formed mark using the set optimal amount of light;

wherein the feedback control adjusts an amount of light of the registration sensor such that a sensed amount of light is adjusted to the predetermined target amount of light, wherein the color registration unit sets the optimal amount of light while rotating the image forming medium and the setting comprises:

providing a predetermined initial control signal to the registration sensor;

sensing an amount of light reflected from the image forming medium;

calculating a control signal according to a difference between the sensed amount of light and a predetermined target amount of light;

determining whether an amount of light of the registration sensor has a stable value or not, by comparing the sensed amount of light and the target amount of light;

if the amount of light of the registration sensor has the stable value, selecting an amount of light of the registration sensor corresponding to the sensed amount of light as the optimal amount of light; and providing the calculated control signal to the registration sensor and repeating the sensing, the calculating, and the determining from when the amount of light of the registration sensor has the stable value to when the image forming apparatus is rotated one additional revolution.

9. The image forming apparatus as claimed in claim 8, wherein the target amount of light is an amount of light at a time when the amount of light reflected from the image forming medium is saturated.

10. The image forming apparatus as claimed in claim 8, wherein the feedback control is at least one of a proportional-integral (PI) control and a proportional-integral derivative (PID) control.

11. The image forming apparatus as claimed in claim 8, further comprising a storage unit which stores the calculated control signal and an amount of light sensed in response to the calculated control signal.

12. The image forming apparatus as claimed in claim 11, wherein the color registration unit calculates an average value of the sensed amount of light and a maximum value of the sensed amount of light using the stored amount of light, selects an amount of light of the registrations sensor unit corresponding to the calculated maximum value as the optimal amount of light, if a difference between the calculated maximum value and the calculated average value is less than a predetermined value, and selects an amount of light of the registration sensor unit obtained by adding a predetermined offset value to an amount of light of the registration sensor corresponding to the calculated average value as the optimal amount of light, if the difference between the calculated maximum value and the calculated average value is greater than the predetermined value.

13. The image forming apparatus as claimed in claim 12, wherein, if the difference between the calculated maximum value and the calculated average value is less than the predetermined value, the color registration sensor unit selects an amount of light of the registration sensor unit corresponding to the calculated average value as the optimal amount of light.

14. The image forming apparatus as claimed in claim 8, wherein the image forming medium is at least one of an organic photo conductor, an intermediate transfer belt, and a paper conveyance belt.

* * * * *